US008353665B1

(12) United States Patent
Stockstill et al.

(10) Patent No.: US 8,353,665 B1
(45) Date of Patent: Jan. 15, 2013

(54) IMPELLER FOR TWO-CHAMBER EXTRACTING BLOWER

(75) Inventors: Frank T. Stockstill, Friendswood, TX (US); Fernando Osornia, Houston, TX (US); Fernando S. Osornia, Humble, TX (US)

(73) Assignee: GlobalTech Motor & Controls, Inc., Pasadena, TX (US)

( * ) Notice: Subject to any disclaimer, the term of this patent is extended or adjusted under 35 U.S.C. 154(b) by 536 days.

(21) Appl. No.: 12/766,209

(22) Filed: Apr. 23, 2010

(51) Int. Cl.
*F04D 17/08* (2006.01)
*B01D 35/00* (2006.01)

(52) U.S. Cl. ..... 415/169.1; 415/101; 415/121.2; 415/206; 416/183; 416/228

(58) Field of Classification Search ..... 415/121.2, 415/169.1, 203, 204, 206, 93, 101, 102; 416/182, 416/183, 187, 195, 228
See application file for complete search history.

(56) References Cited

U.S. PATENT DOCUMENTS

| | | | | |
|---|---|---|---|---|
| 1,620,875 | A * | 3/1927 | Currie | 416/195 |
| 1,785,918 | A | 12/1930 | Stebbins | |
| 2,209,607 | A | 7/1940 | Nutting | |
| 2,293,590 | A * | 8/1942 | Chance | 209/250 |
| 2,297,050 | A * | 9/1942 | Cotton et al. | 417/350 |
| 2,780,309 | A | 2/1957 | Loftheim | |
| 3,868,236 | A | 2/1975 | Meier et al. | |
| 4,361,490 | A | 11/1982 | Saget | |
| 4,478,718 | A | 10/1984 | Saget | |
| 4,904,159 | A * | 2/1990 | Wickoren | 416/183 |
| 5,514,206 | A | 5/1996 | Hoogesteger et al. | |
| 5,755,096 | A | 5/1998 | Holleyman | |
| 5,782,605 | A * | 7/1998 | Kohler | 415/121.1 |
| 6,293,751 | B1 * | 9/2001 | Stockstill | 415/1 |
| 6,406,506 | B1 | 6/2002 | Moredock et al. | |
| 6,648,935 | B2 * | 11/2003 | Petersen, Jr. | 55/406 |
| 6,648,936 | B2 | 11/2003 | Higashino et al. | |
| 6,802,881 | B2 | 10/2004 | Illingworth et al. | |
| 6,905,535 | B2 | 6/2005 | Keefer et al. | |
| 7,258,713 | B2 | 8/2007 | Eubank et al. | |
| 2009/0191049 | A1 | 7/2009 | Aubin et al. | |

* cited by examiner

*Primary Examiner* — Edward Look
*Assistant Examiner* — Liam McDowell
(74) *Attorney, Agent, or Firm* — Crain, Caton & James, P.C.; James E. Hudson, III

(57) ABSTRACT

An impeller for use in a two-chamber extracting blower that separates liquid and solid contaminants from a supply of and provides a supply of clean air moving at high velocity air. The impeller includes a plurality of blades wherein each blade includes a first section perpendicular to and formed of the blade and a second section perpendicular to the first section, also formed of the blade and radiating outward. The height of each section and the construction of the main section of the blade create differing pressure zones during rotation of the impeller, segregating air contain the impurities and prompting separation of the impurities. The construction of the first and second sections promotes more efficient and quieter operation, strengthens the blade, and permits removal of the impeller.

14 Claims, 11 Drawing Sheets

IMPELLER FOR TWO-CHAMBER EXTRACTING BLOWER

CROSS-REFERENCE TO RELATED APPLICATIONS

None.

STATEMENT REGARDING FEDERALLY SPONSORED RESEARCH OR DEVELOPMENT

Not Applicable.

BACKGROUND OF THE INVENTION

1. Field of Invention

The present invention pertains to two-chamber extracting blowers that separate liquid and solid contaminants from a supply of and provide a supply of clean air moving at high velocity air.

2. Description of the Related Art

Blowers for providing air flow are well known. Also well known is the obstacle of heavier-than-air contaminants in the air intake and the desire to remove those contaminants before outflow, particularly as such contaminants can be damaging to downstream equipment. The prior art includes two-chamber extracting blowers that separate contaminants from an intake supply and provide a supply of clean air moving at high velocity. These blowers typically function by rotating an impeller within a divided housing, which draw air axially into the housing and across the blades of the impeller and use the centrifugal effect of the blades to separate the air from the heavier contaminants. In operation, the construction of the blades of the impeller create an area of low pressure that draws air into the blower. Once drawn into the blower, the rotation of the blades causes the air to be forced radially outward between the blades. The air having little or no contamination is quickly forced to the edge of the blades before that air can pass axially into the second chamber within the housing. Air carrying contaminants and having momentum from being drawn into the blower continues axially moving into the second chamber and is redirected by the rotation of the blades in that second chamber, causing the air and contaminants to be directed to the exterior of the second chamber, wherein the contaminants are expelled. This construction has shortcomings, including blade maintenance, noise generation, and effectiveness.

Prior attempts to overcome these shortcomings have included notching the outer edge of the impeller blades to extend about the housing divider or partition separating the first and second chambers (the clean and dirty air chambers). While reducing the contaminant-free air lost to the second chamber, this construction can impede the motion of contaminant-bearing air to the second chamber and precludes removal of the impeller without simultaneous removal of the partition. Impeller removal can be of significant importance when trying to maintain clean blades so as to promote direction of contaminant-free air.

Other prior art attempts have utilized a wiper welded to each blade to guide contaminants to the second chamber. However, because contaminant-bearing air necessarily is flowing over and impacting the weld, the weld surface can become pitted and subject to abrasion. Moreover, as the weld is contacted by corrosive contaminants, the weld is further weakened, causing the cracks inherent in a weld to propagate.

Other prior art attempts have attempted to use wiper-free blades in an impeller notch about the chamber partition in conjunction with an third chamber formed on the outer edge of the first chamber to skim the air of the first chamber for lighter contaminants and heavier contaminants which did not pass to the second chamber are separated from the volume of "clean" air exiting the blower and to cause the contaminants in the air to be ejected with the contaminant-bearing air. This construction, however, requires the addition of components to the housing.

Other prior attempts have attempted to affix a wiper to each blade of an impeller notch about the chamber partition and to construct the blades of the impeller to provide differing cross-sectional areas for the portions of each blade in the first and second chambers to provide pressure differentials between the two chambers. Thus, in addition to shortcomings of a wiper-based impeller, the impeller cannot be easily removed.

Thus, there is a need in the art for an impeller for use in an two-chamber contaminant-extracting blower which operates efficiently and more quietly, permits ease of access and removal of the impeller, avoids welds and additional parts, and generates a pressure differential between the two chambers.

SUMMARY OF THE INVENTION

The present invention therefore meets the above needs and overcomes one or more deficiencies in the prior art by providing an impeller with blades with cross sections areas sized to the two chambers, increases the efficiency of removal of contaminants, avoids the notching about the partition between the chambers, and features sections of the blade bent to provide increased strength Unlike prior inventions, the invention avoids the notch fixing the impeller within the blower housing, avoids the use of crack-inducing welds in favor of material bending, and utilizes differing sizes for the first and second sections of the blade outer edge to promotion air flow and contaminant separation.

In particular, the invention, which may be a blower or the impeller for use in a two-chamber contaminant-extracting blower, where the impeller includes a rear circular plate with a mounting hub and a plurality of outwardly-radiating blades affixed thereto sized to fit within the housing of the blower, and each blade includes a second-chamber section extending from the mounting hub and having a large cross-sectional area, a first-chamber section extending upward from the outer portion of the second-chamber section, a first blade extension formed by perpendicularly bending the portion of the blade extending beyond the second-chamber section and which extends from the first-chamber section of the blade into the second-chamber section of the blade, and a second blade extension formed by perpendicularly bending a portion of the first blade extension to be parallel to and outwardly extending from the blade and which extends from the first-section of the toward the end of the first blade extension.

Additional aspects, advantages, and embodiments of the invention will become apparent to those skilled in the art from the following description of the various embodiments and related drawings.

BRIEF DESCRIPTION OF THE DRAWINGS

So that the manner in which the described features, advantages, and objects of the invention, as well as others which will become apparent are attained and can be understood in detail; more particular description of the invention briefly summarized above may be had by referring to the embodiments thereof that are illustrated in the drawings, which drawings form a part of this specification. It is to be noted, however, that the appended drawings illustrate only typical preferred embodiments of the invention and are therefore not to be considered limiting of its scope as the invention may admit to other equally effective embodiments.

In the drawings.

DESCRIPTION OF THE PREFERRED EMBODIMENT

Figure 1:
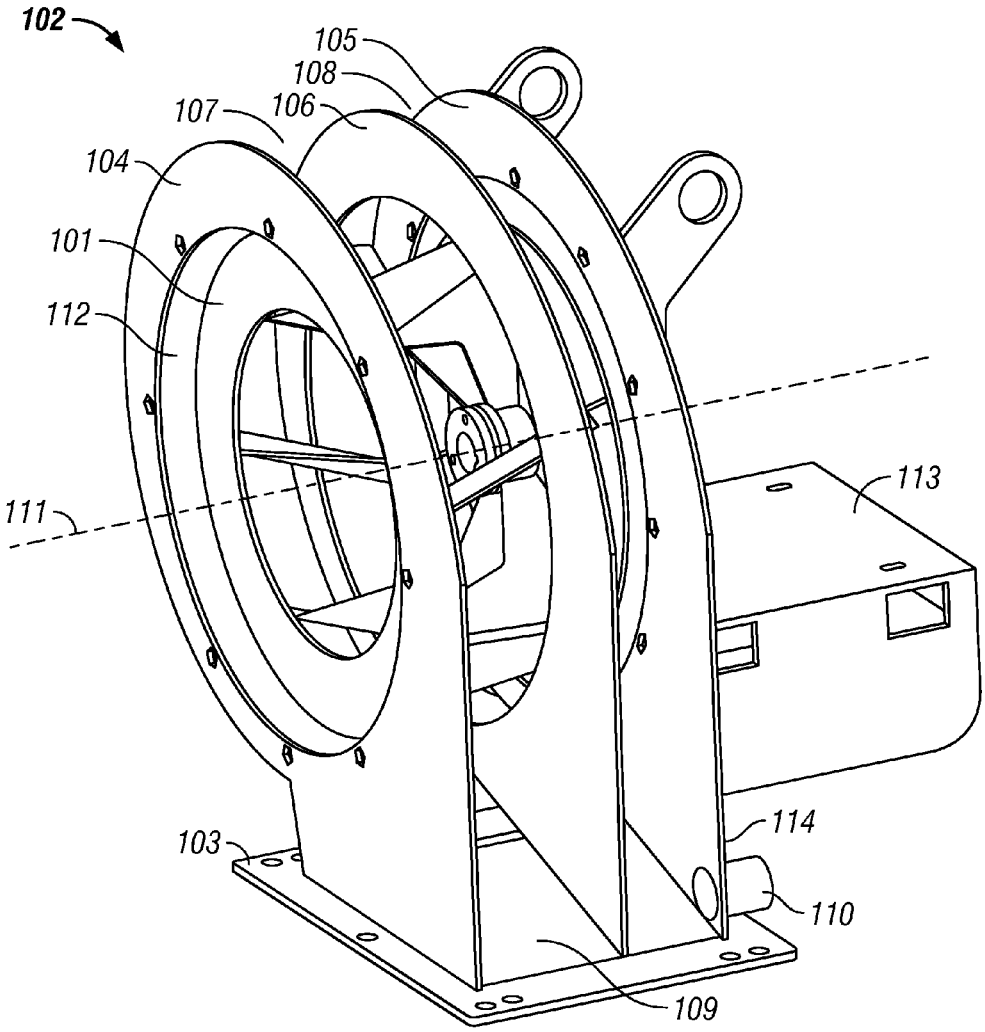
FIG. 1 is an illustration of a view one embodiment of the present invention of the impeller positioned relative to the housing.
Figure 6:
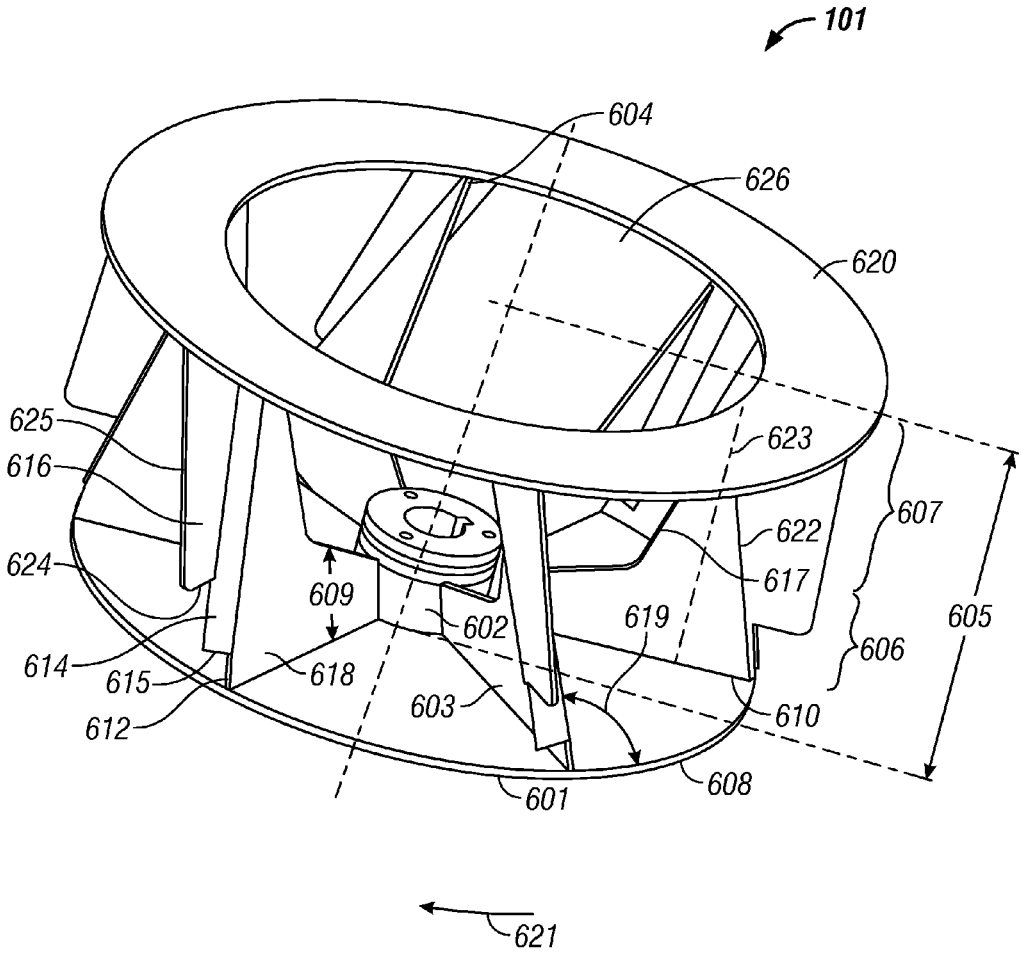
FIG. 6 is an illustration of one embodiment of the impeller of the present invention.

Referring primarily to FIGS. 1 and 6, the invention, which may be a blower 102 or the impeller 101 for use in a two-chamber contaminant-extracting blower 102, includes a mounting hub 602 and a plurality of outwardly-radiating blades 603 affixed thereto sized to fit within the housing 103 of the blower 102, and each blade 603 includes a second-chamber section, or lower main blade section 606, extending from the mounting hub 602 and having a large cross-sectional area, a first-chamber section, or upper main blade section, 607 extending upward from the outer portion of the second-chamber section 606, a first blade extension 614 formed by perpendicularly bending the portion of the blade 603 extending beyond the second-chamber section 606 and which extends from the first-chamber section 607 of the blade 603 into the second-chamber section 606 of the blade 603, and a second blade extension 616 formed by perpendicularly bending a portion of the first blade extension 614 to be parallel to and outwardly extending from the blade 603 and which extends from the first-chamber section 607 of the blade 603 toward the end 615 of the first blade extension 614. The embodiment may further include a rear circular plate 601 which may be solid to provide a surface against which contaminants may collide and then be redirected by blades 603.

Referring to FIG. 1, the blower housing 103 includes a housing front wall 104, a partition 106, and a housing rear wall 105, with at least the front housing wall 104 and the partition 106 having a circular opening therethrough with a common longitudinal axis 111, and sized to permit the impeller 101 to pass therethrough. Housing 103 includes an intake opening 112 in communication with said front chamber 107. Housing rear wall 105 may likewise have a similarly sized opening if the impeller 101 is to pass through the housing rear wall 105 to permit rear removal. When enclosed with the housing side wall 901 depicted in FIG. 9, the front housing wall 104 and the partition 106 form a front housing chamber, or front chamber, 107. Likewise, when enclosed with the housing side wall 901 depicted in FIG. 9, the rear housing wall 105 and the partition 106 form a rear housing chamber, or rear chamber, 108. The front chamber 107 is in communication with a front chamber outlet 109, permitting air regarded as contaminant free, or clean, to exit the blower 102. Similarly, the rear chamber 108 is in communication with a rear chamber outlet 110, permitting contaminants and/or air regarded as containing or bearing contaminants, or dirty air, to exit the blower 102. As depicted in FIGS. 1-5 and 8-9, the impeller 101 is positioned within the housing 103 and in front chamber 107 and the rear chamber 108. A motor (not shown) may be positioned adjacent to or fixed to the housing 103, such as at a motor mount 113, and the motor shaft coupled to the impeller 101.

Figure 2:
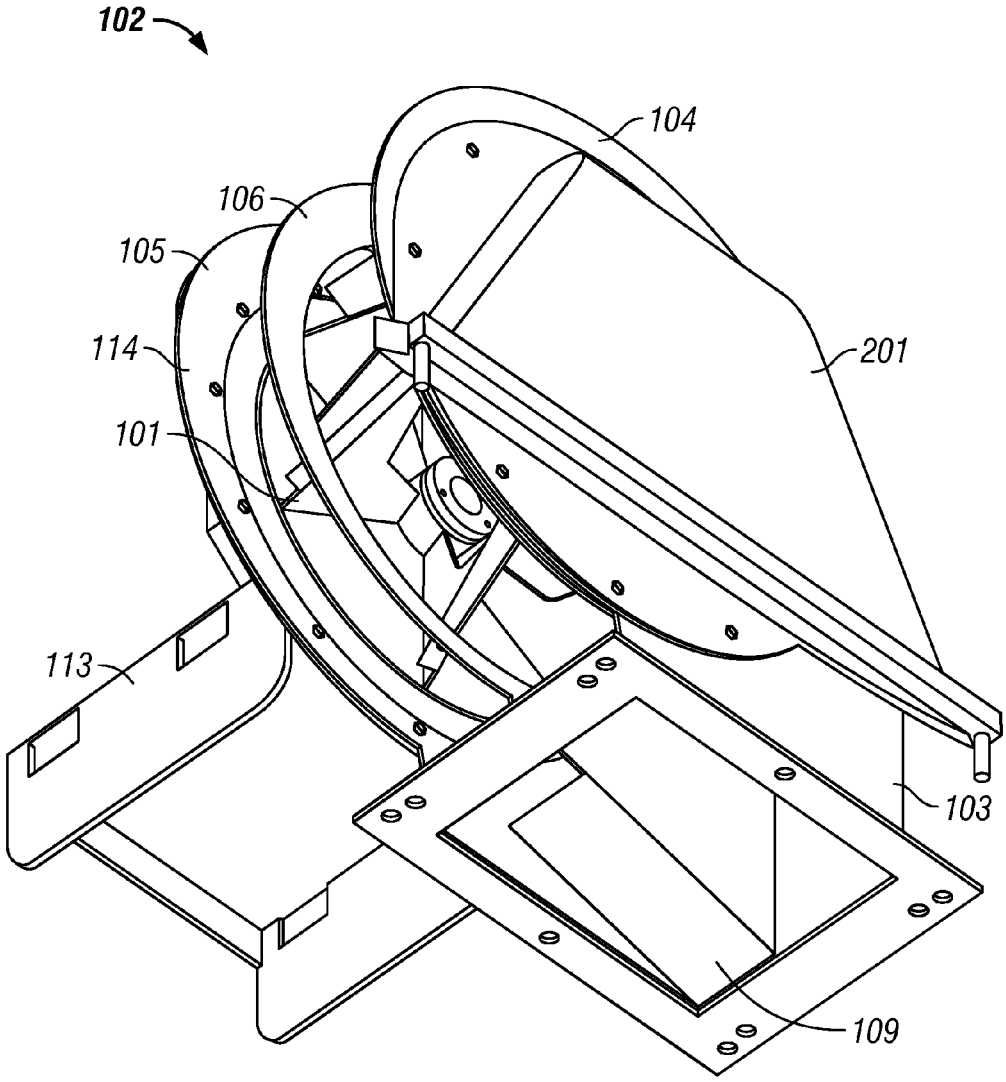
FIG. 2 is an illustration of a bottom view of one embodiment of the present invention of the impeller positioned relative to the housing and the intake cover.
Figure 3:
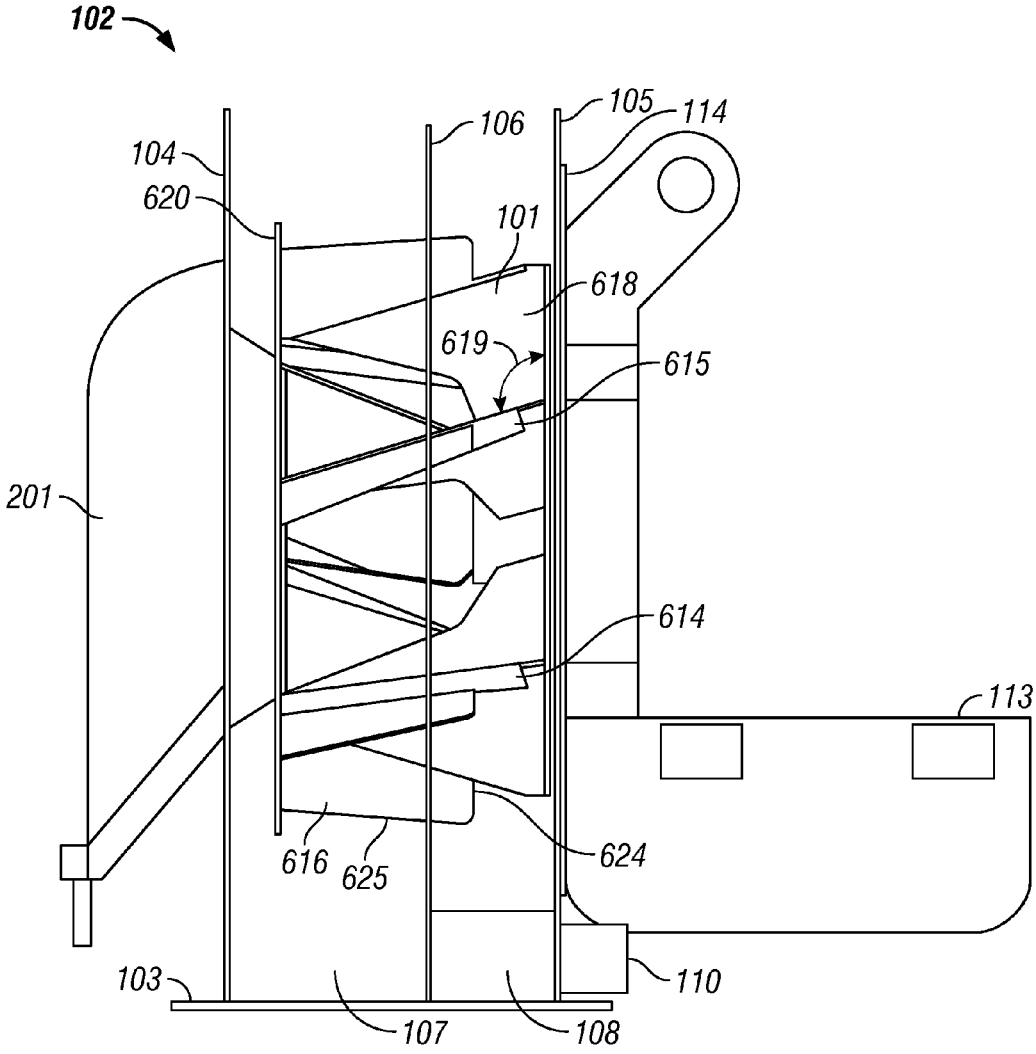
FIG. 3 is an illustration of a side view of one embodiment of the present invention of the impeller positioned relative to the housing and the intake cover.
Figure 4:
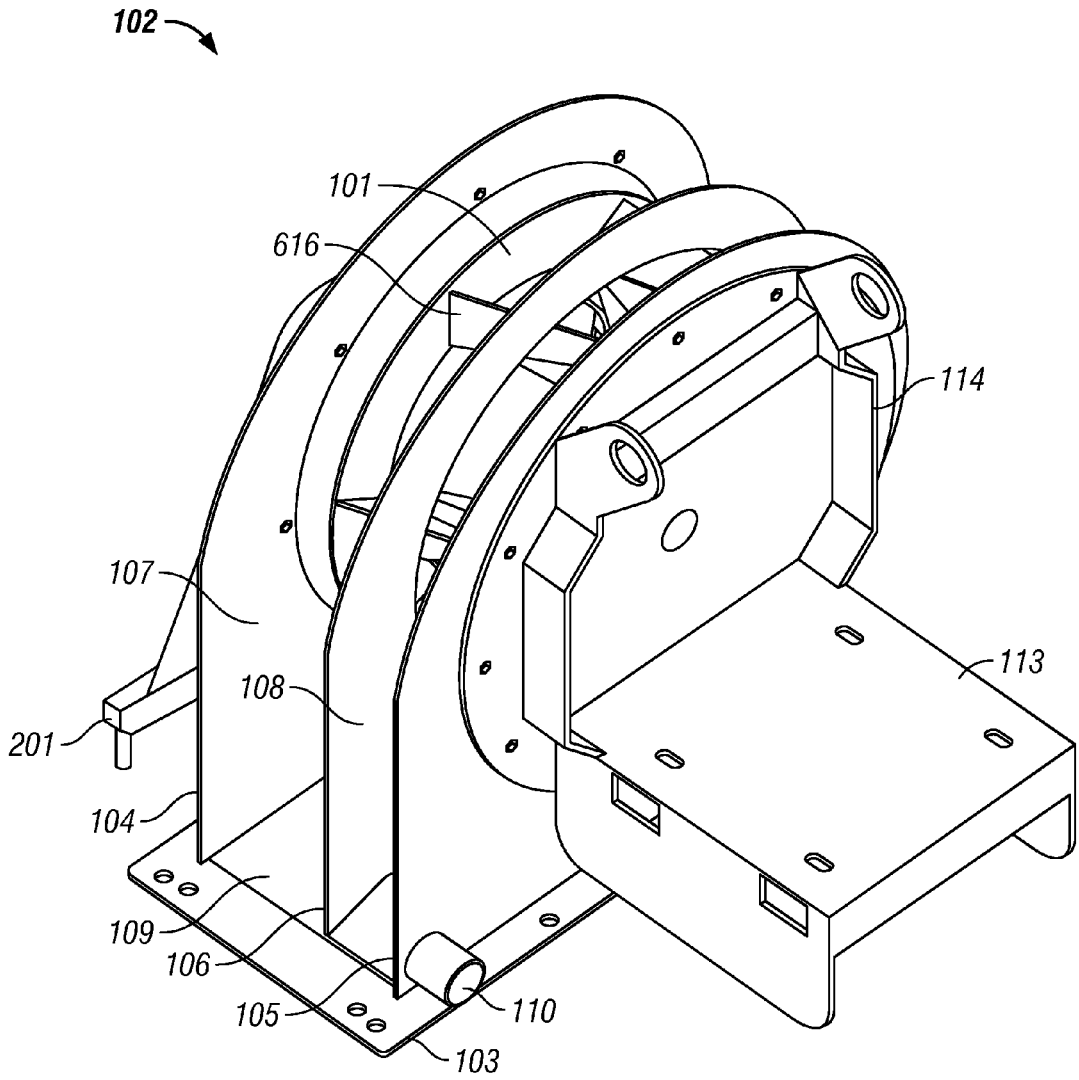
FIG. 4 is an illustration of a rear view of one embodiment of the present invention of the impeller positioned relative to the housing and the intake cover.
Figure 5:
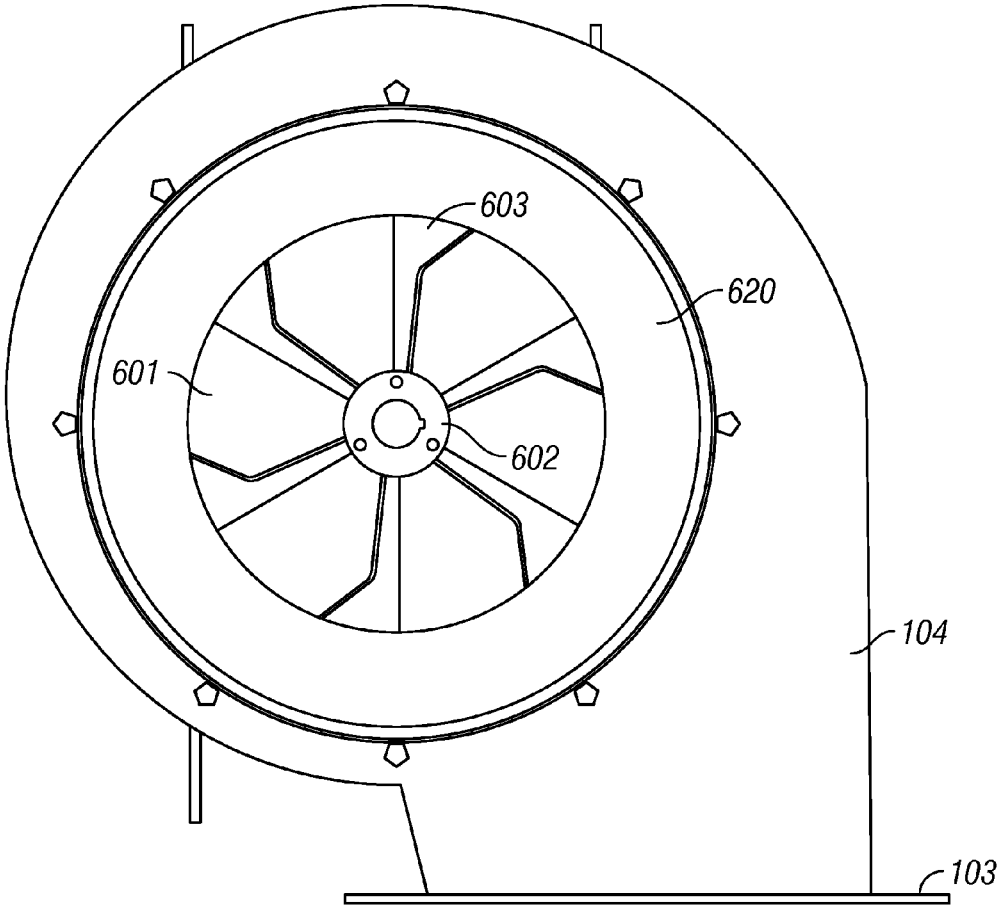
FIG. 5 is an illustration of a side view of one embodiment of the present invention of the impeller positioned within the housing and the housing side cover.

Referring to FIGS. 2, 3 and 4, the blower 101 may further include an intake cover 201, which is fixed to housing 103 adjacent the housing front wall 104. The intake cover 201 covers the opening in housing front wall 104 and permits air flow to the front housing chamber 107 while protecting blower 102.

Referring to FIG. 3, the intake cover 201 may permit air flow to the front housing chamber 107 through an opening near the housing 103 to limit the access to front housing chamber 107 to air only.

Referring to FIGS. 3 and 6, the impeller 101 includes a mounting hub 602 at its center, adapted to connect to a driven shaft. The impeller 101 further includes a plurality of outwardly-radiating blades 603 affixed thereto sized to a blade height 605 to fit within the housing 103 of the blower 102 and radiating outward from the center of the impeller 102. Thus, each of the blades 603 has a blade height 605 sufficient to position the to top edge 604 of the blade 603 adjacent the housing front wall 104 when the impeller 101 is installed in the blower 102. Each of the blades 603 is fixed in relation to the mounting hub and to each other, which may be, among other structures, by permanently affixing each blade 603 to the mounting hub 602 or by permanently affixing each blade 603 to a rear circular plate 601 and the mounting hub 602 to the rear circular plate 601.

Figure 11:
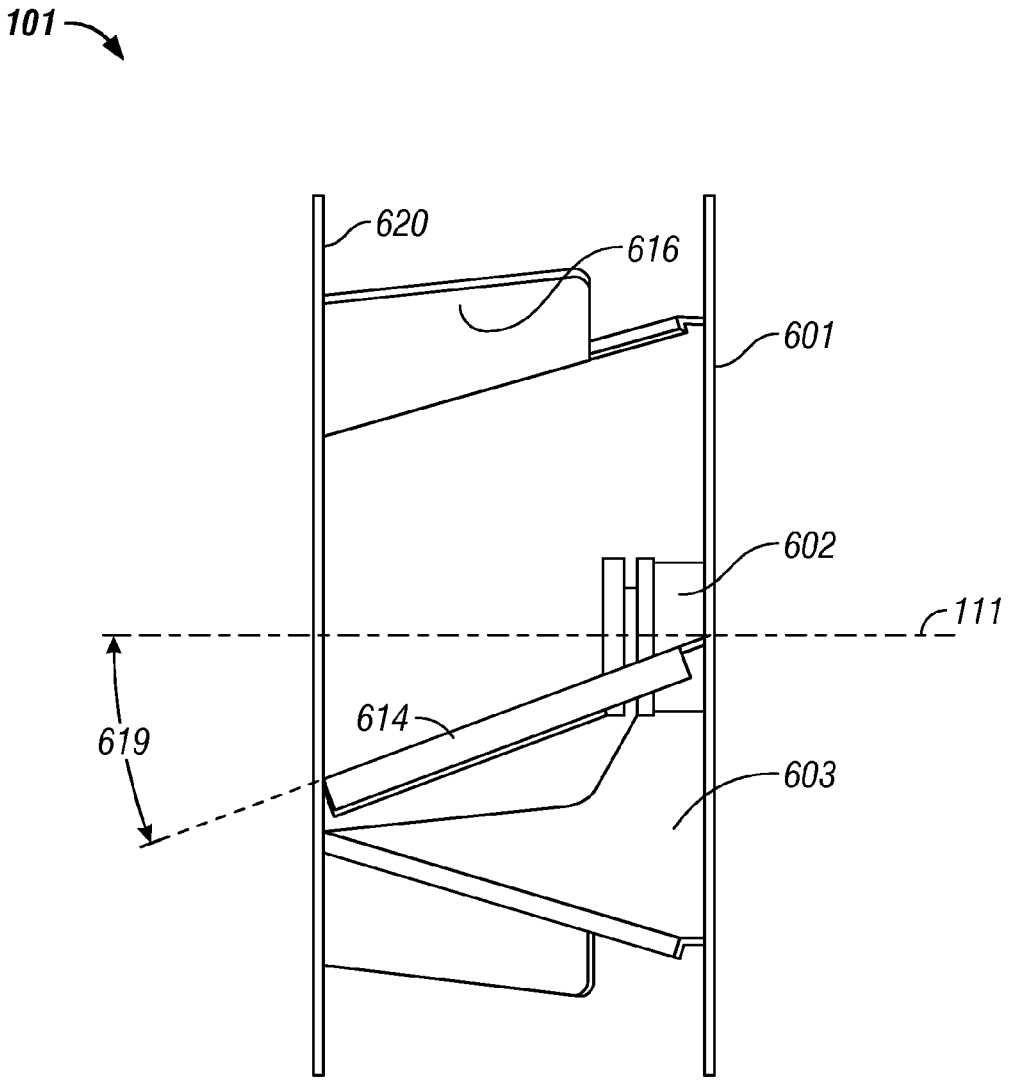
FIG. 11 is an side-view illustration of an embodiment of the impeller of the present invention.

Each blade 603 has a main blade section 618 which may be considered to have a lower main blade section 606, and an upper main blade section 607. The main blade section 618 has a lower outer edge 612, which is proximate the outer edge 608 of said rear circular plate 601, when the circular plate 601 is used and has a lower main blade section bottom edge 610, which is permanently attached to the rear circular plate 601, when the circular plate 601 is used. Referring to FIGS. 6 and 11, each blade 603 may be inclined in the lower outer edge 612 of the impeller 101 in the direction 621 of rotation. This blade has an incline 619 in the range of 60 to 80 degrees, relative to the rear circular plate 601, and optimally at 70 degrees. This incline 619 reduces noise and increases efficiency.

Returning to FIG. 6, the lower main blade section 606 of each blade 603 extends from proximate, or about or near to, the center of the rear circular plate 601 or the mounting hub 602. The lower main blade section 606 has a length extending to proximate, or about or near to, the rear circular plate outer edge 608, if the rear circular plate 601 is present, but in all respects, sized to fit within the openings of at least the housing front wall 104 and the partition 106 and potentially the housing rear wall 105. Ideally, the lower main blade section 606 increases in height 609 distant from the center of the rear circular plate 601 or the mounting hub 602 but does not become so tall as to extend above the rear housing chamber 108. Thus, the lower main blade section height 609 of each of lower main blade section 606 is preferably sufficient to position the lower main blade section 606 solely within the rear housing chamber 108, and not within the housing front chamber 107 when the impeller 101 is installed in the blower 102.

The upper main blade section 607 of each blade 603 extends upward from the lower main blade section 606 to the top edge 604 of the blade 603. The upper main blade section 607 presents a trapezoidal cross section from the lower main blade section 606, characterized by the upper blade section inner edge 617 and the upper blade section outer edge 622 both approaching a centerline 623 of the upper main blade section 607 towards the top edge 604 of the blade 603, which centerline 623 is perpendicular to the rear circular plate 601. The shape of the upper main blade section 607 of each blade 603 is thus sufficiently open at its center to create a pressure differential during rotation between the air contacting the upper main blade section 607 and the air contacting the lower main blade section 606.

Each blade 603 also includes a first blade extension 614 extending along the upper main blade section 607 to along the lower main blade section 606. Thus, the first blade extension 614 extends along the upper main blade section 607 and preferably covers the entirety of the upper main blade section 607 to ensure contaminants in the housing front chamber 107 are captured and redirected to the rear housing chamber 108. The first blade extension 614 has an end 615 some distance from the rear circular plate 601, providing, inter alia, an opening for carried contaminants to fall into the rear housing chamber 108. Also differing from the prior art, this first blade extension 614 is integrally formed of the blade 603 by bending the material, rather than by welding. Preferably, the first blade extension 614 is bent to an angle of 90' relative to the main blade section 618 and in the direction 621 of the rotation of impeller 101, such that the first blade extension 614 leads the main blade section 618.

Each blade 603 also includes a second blade extension 616 extending from the first blade extension 614 in a plane parallel to said main blade section 618 and extending away from said main blade section 618. This second blade extension 616 extends along the outer edge of the first blade extension 614 to a second blade extension lower edge 624, which is some distance from the first blade extension end 615, and intermediate the upper main blade section 607 and said rear circular plate 601 or lower edge of the main blade section 618, providing, inter alia, an opening for carried contaminants to fall into the rear housing chamber 108. Also differing from the prior art, this second blade extension 616 is integrally formed of the blade 603 by bending the material, rather than by welding. Preferably, the second blade extension 616 is bent to an angle of 90' relative to the first blade extension 614 so as to be parallel to the plane of the main blade section 618. The second blade extension 616 has a second blade extension outer edge 625 which is parallel to said housing longitudinal axis 111.

The blade top edge 604 of each blade 603, and therefore the position of each blade 603, may be maintained in relative position by permanently affixing a front circular plate 620, with an orifice 626 therethrough to the blade top edge 604 of each blade 603. Ideally the opening or orifice 626 is sufficiently sized to permit the sufficient inflow of air to the impeller 603 in operation. This may be accomplished by using a front circular plate which presents a surface no wider than the blade top edge 604 of each blade 603. Alternatively, the blades 603 may be maintained in position by the use of struts 1001 between and among the blades 603.

In operation, the main blade section 618, the first blade extension 614 and the second blade extension 616, in conjunction with the pitch or blade incline 619 of the impeller blade 603 and the speed of rotation of impeller 101 funnel residual impurities to the rear housing chamber 108 and does so more efficiently and provides quieter operation, in part because of the blade incline 619 of the blade 603 and because the first blade extension 614 and the second blade extension 616 are made part of the blade 603 with smooth radius bends of a single material sheet rather than a rough weld. This construction allows for a more laminar flow across the blade 603.

Figure 7B:
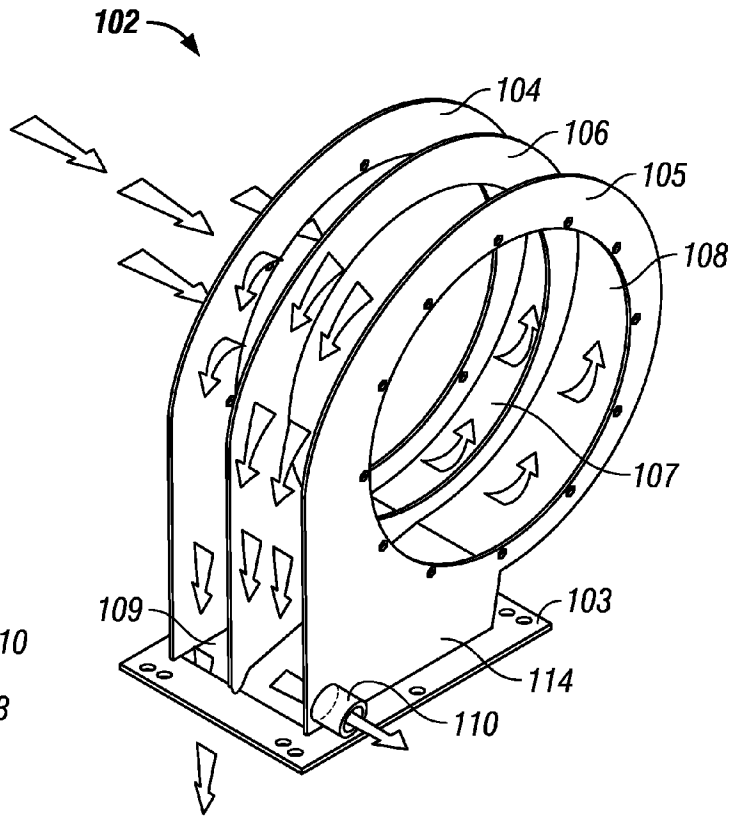
FIG. 7B is an illustration of a view of one embodiment of the present invention showing the air movement through the housing during operation.
Figure 7A:
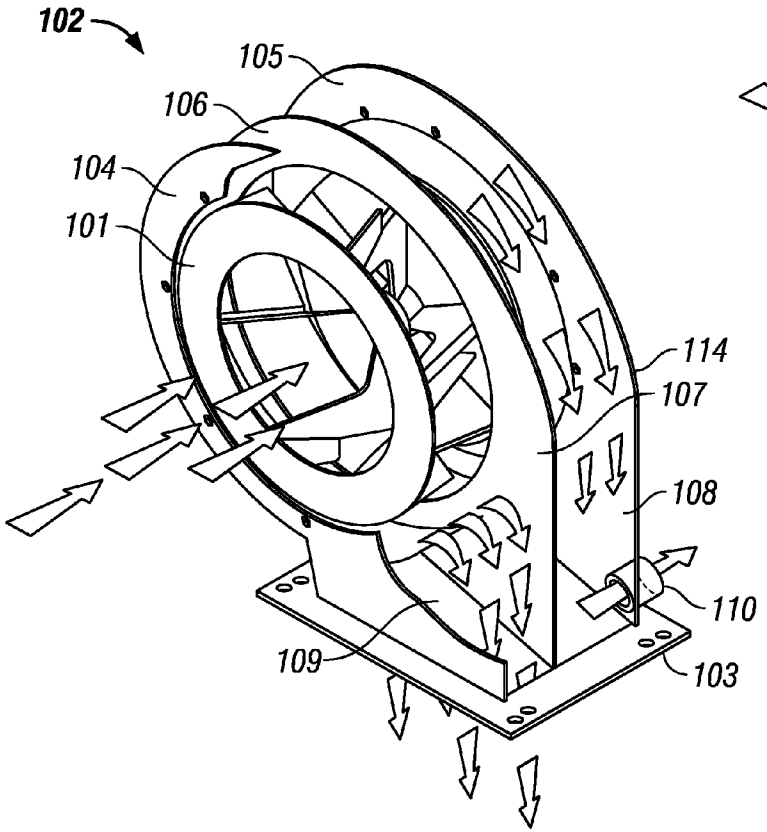
FIG. 7A is an illustration of a cutaway view of one embodiment of the present invention of the impeller positioned relative to the housing and showing the air movement through the housing during operation.
Figure 8:
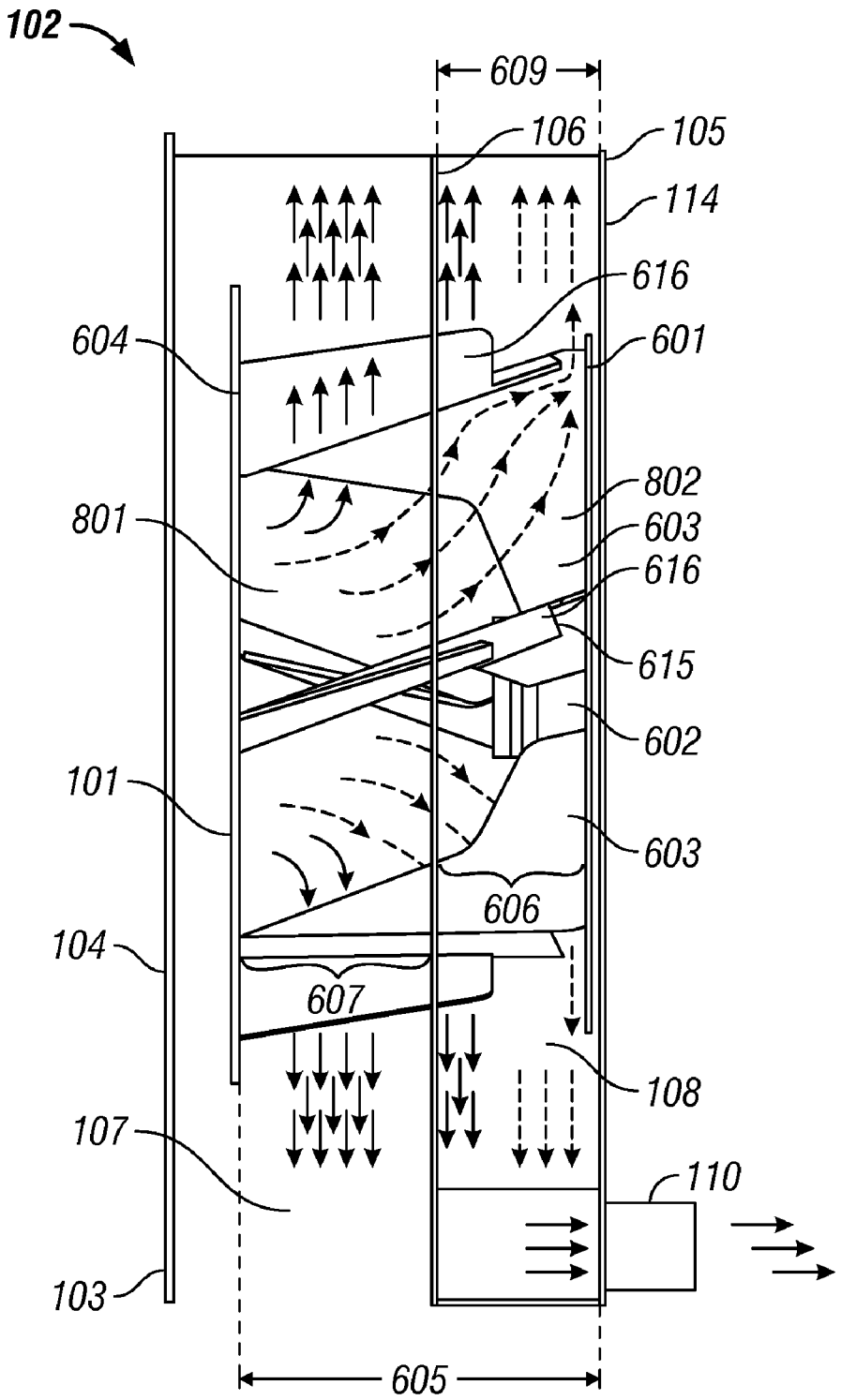
FIG. 8 is an illustration of a side view of one embodiment of the present invention of the impeller positioned relative to the housing and showing the air movement through the housing during operation.
Figure 9:
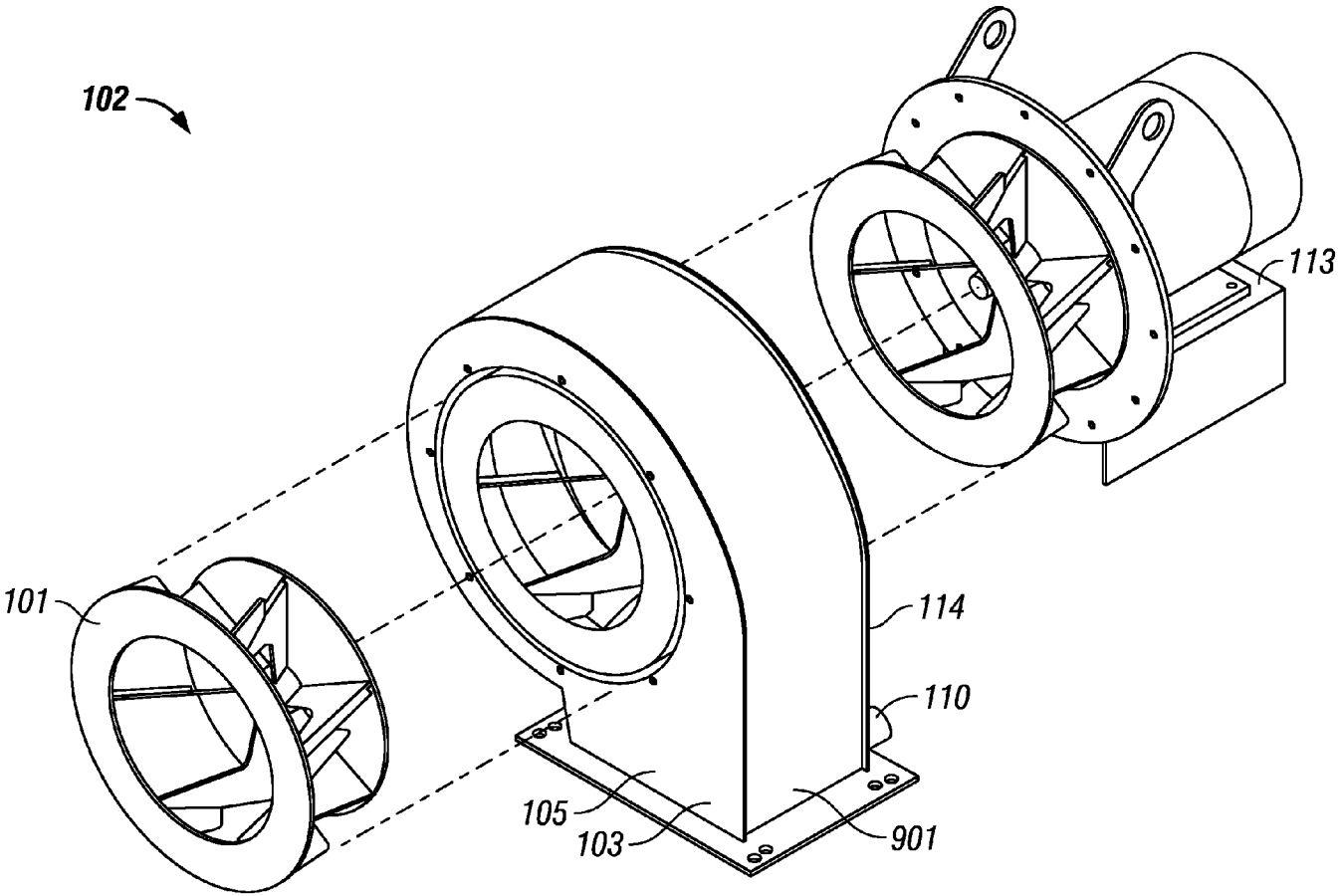
FIG. 9 is an illustration of a side view of one embodiment of the present invention of the impeller positioned within the housing and the housing side cover.
Figure 10:
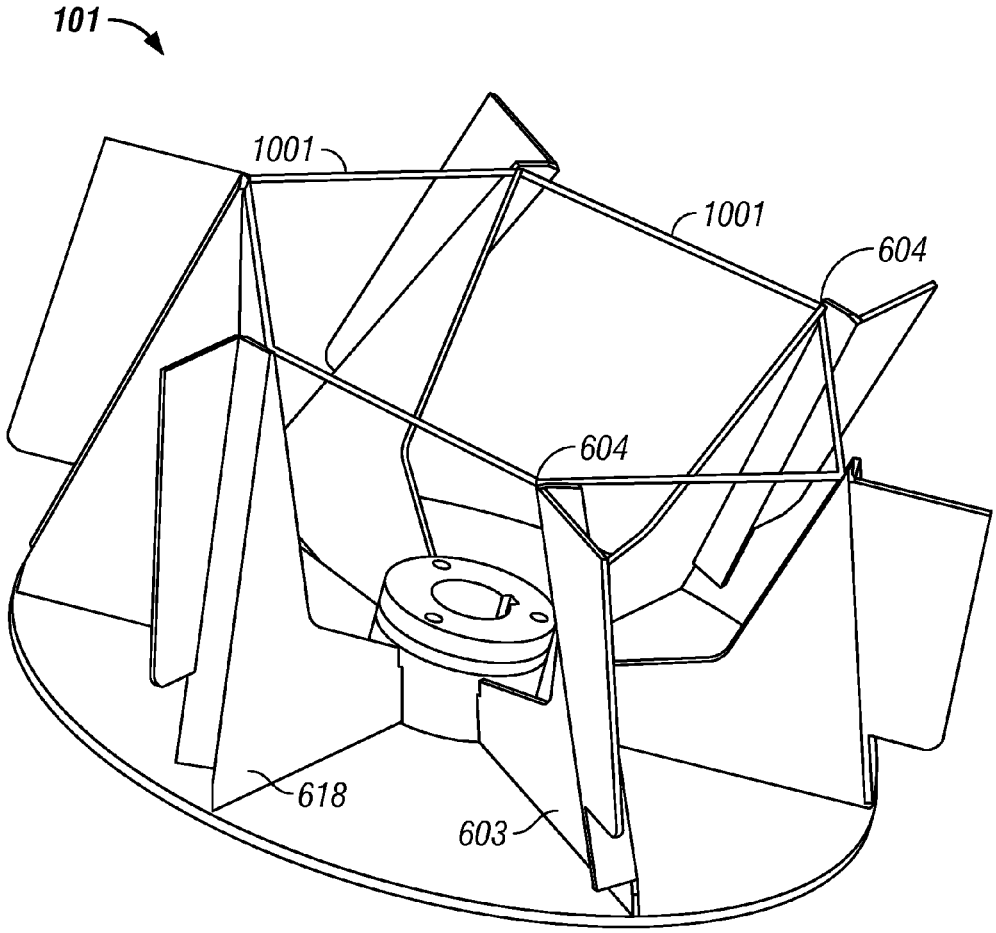
FIG. 10 is an illustration of an alternate embodiment of the impeller of the present invention.

Referring to FIGS. 7A and 7B, when energized, the rotary drive drives the shaft mounted impeller 101. As the impeller 101 turns, centrifugal forces build and the impeller blades 603 propel the air within the inside diameter of the impeller 101 into the front housing chamber 107 and the rear housing chamber 108. The rotating blades 603 of the impeller 101 propel the air outward into the housing 103 creating a cyclonic current of air within both the front housing chamber 107 and the rear housing chamber 108 moving in the direction of rotation 621. The current of air within the front housing chamber 107 is directed through the front chamber outlet 109 and directly into the area being cooled. While the current of air within the rear housing chamber 108 remains segregated and is directed through the rear chamber outlet 110. As the air leaves the area within the inside diameter of the impeller 101, a low pressure zone, or first impeller zone, 801 is created and new air rushes in through the intake cover to fill this low pressure zone 801. This new, "dirty" air, depending on the operating environment, can contain water droplets, dust, dirt, sand, bugs, etc, collectively referred to as "impurities". As the speed of rotation of the impeller 101 increases, the pressure drops and the speed of the incoming dirty air increases to fill this low pressure zone 801.

The unique design of the impeller blades 603 creates two distinct pressure zones 801, 802 within the impeller 101, the low pressure zone 801 and a second impeller zone 802 which helps separate the impurities. The portion of the blade 603, including the upper main blade section 607 and portions of the first blade extension 614 and the second blade extension 616, in the front housing chamber 107 is designed to direct more air into the front housing chamber 107. Because more air is moving into the housing front housing chamber 107, the pressures around the leading edge of the blades 603 over the low pressure zone 801 are lower than the pressures around the leading edge of the impeller blades 603 over the second impeller zone 802. This area of lower relative pressure attracts more of the incoming airstream as it first enters. However, due to the abrupt change in direction needed to move into the front housing chamber 107, the speed of the airstream, the mass and inertia of the impurities, only clean air is pulled directly in the low pressure zone 801. The remainder of the airstream continues into the second impeller zone 802. In the second impeller zone 802, the incoming airstream meets the higher pressure area (relative to the low pressure zone 801), which begins to slow the forward motion of the air and deflect the airstream outward. The forward motion of the lighter air slows more quickly and the heavier impurities travel further into the second impeller zone 802, due to their higher relative mass and inertia. In the second impeller zone 802, the air and impurities are struck with the wider lower main blade section 606 of impeller blade 603. The angular design combined with the speed of rotation act to move both the air and impurities in a downward and lateral motion toward the rear housing chamber 108. As the impurities migrate down and out they enter the rear housing chamber 108 where they are caught in the cyclonic effect described earlier and washed around the housing and funneled to the rear chamber outlet 110 for the rear housing chamber and discarded. The heavier the impurity, the further it travels into zone two before being swept down and out by the pitch of the impeller.

A portion of the impurities may come into contact with the impeller blades 603 relatively high in the second impeller zone 802 where they may be drawn back toward the low pressure zone 801 by the lower pressures associated with it. When this happens the impurities migrate along the impeller blade 603 in an outward motion. Unlike the prior art, the unique shape of the impeller blade redirects the migration down toward the second impeller zone 802 and out through the rear chamber outlet 110.

The impeller 101 further differs from the prior art by elimination of the notching present in many impellers to accommodate the partition 106, which elimination permits removal of the impeller 101 from either side of the housing 103. Previously, the use of a notch was necessary to improve the seal between the housing front chamber 107 and the rear housing chamber 108, but prevented removal of the impeller 101 from the rearside 114. The unique design of the impeller 101 of the present invention avoids the need for a notch by creating an isolating wind curtain around the air gap between the impeller blade 603 and the partition 106. This isolating wind curtain is created by continuing the second blade extension 616 of the blade 603 dedicated to moving higher velocity air into the low pressure zone 801 into the rear housing chamber 108, creating a curtain of higher speed air which runs across the gap and along the portion of the rear housing chamber 108 adjacent the partition 106. This curtain of high speed air at a portion of rear housing chamber 108 seals the gap between the partition 106 and the impeller 101, allowing for additional clearance. The additional clearance between the partition 106 and impeller 101 makes removal of impeller 101 via the rearside 114 possible.

The terms and expressions which have been employed in the foregoing specification are used therein as terms of description and not of limitation, and there is no intention, in the use of such terms and expressions, of excluding equivalents of the features shown and described or portions thereof.

We claim:

1. An impeller for use in a contaminant-extracting blower,
said blower having a housing,
said housing having a housing front wall, a housing rear wall, a housing longitudinal axis, a housing side wall, and a partition,
said partition intermediate said housing front wall and said housing rear wall,
said partition defining a housing front chamber intermediate said housing front wall and said partition and a rear housing chamber intermediate said housing rear wall and said partition,
said partition having a circular opening therethrough;
said housing having a front chamber outlet positioned in communication with said housing front chamber;
said housing having a rear chamber outlet positioned in communication with said rear housing chamber;
said housing having an intake opening in communication with said front chamber;
said impeller comprising:
a rear circular plate;
a mounting hub,
said mounting hub adapted to be rotatably driven,
said mounting hub positioned at a center of said rear circular plate;
a plurality of blades,
each of said blades affixed to said rear circular plate,
each of said blades radiating from said mounting hub,
each of said blades having a blade top edge
each of said blades having a blade height
said blade height of each of said blades sufficient to position said blade top edge adjacent said housing front wall when said impeller is installed in said blower;
each of said blades having a main blade section,
said main blade section having a lower main blade section,
said lower main blade section extending from proximate said center of said rear circular plate to proximate an outer edge of the rear circular plate,
said lower main blade section increasing in height distant said center of said rear circular plate,
said lower main blade section height of each of said lower main blade section sufficient to position said lower main blade section within said rear housing chamber when said impeller is installed in said blower;
said main blade section having an upper main blade section,
said upper main blade section extending upward from said lower main blade section to said top edge of said blade,
said upper main blade section having a centerline perpendicular to said rear circular plate,
said upper main blade section having an upper blade section inner edge and an upper blade section outer edge,
said upper blade section inner edge nearing said centerline proximate said top edge,
said upper blade section outer edge nearing said centerline proximate said top edge
said main blade section having a lower outer edge,
said lower outer edge proximate said outer edge of said rear circular plate
each of said blades having a first blade extension
said first blade extension extending along said upper main blade section to along said lower main blade section,
said first blade extension having a first blade extension first edge
said first blade extension first edge being distant from said rear circular plate and intermediate
said main blade upper section and said rear circular plate,
said first blade extension integrally formed of each of said blades by a bend of approximately 90° in each of said blades from said main blade section; and each of said blades having a second blade extension
said second blade extension in a plane parallel to said main blade section;
said second blade extension extending away from said main blade section;
said second blade extension extending along said first blade extension
said second blade extension having a second blade extension lower edge
said second blade extension lower edge being distant from said first blade extension first edge and intermediate said main blade upper section and said rear circular plate,
said second blade extension integrally formed on said first blade extension by a bend of approximately 90° in each of said blades,
said second blade extension having an second blade extension outer edge, and
said second blade extension outer edge parallel to said housing longitudinal axis.

2. The impeller of claim 1, further comprising:
said rear circular plate being solid.

3. The impeller of claim 2, further comprising:
each of said blades being inclined relative to said longitudinal axis.

4. The impeller of claim 3, further comprising:
a front circular plate,
said front circular plate affixed to said blade at said top edge, and
said front circular plate having a circular opening therethrough.

5. The impeller of claim 3, further comprising:
a front plurality of struts,
each of said front plurality of struts affixed to a plurality of said main blade section of each of said blades at said top edge.

6. The impeller of claim 2, further comprising:
each of said blades being inclined in a direction of rotation of said impeller.

7. The impeller of claim 6, further comprising:
each of said blades being inclined about 70 degrees relative to said centerline in the direction of rotation of said impeller.

8. A contaminant-extracting blower, comprising:
a housing,
said housing having a housing front wall, a housing rear wall, a housing longitudinal axis, a housing side wall, and a partition,
said partition intermediate said housing front wall and said housing rear wall,
said partition defining a housing front chamber intermediate said housing front wall and said partition and a rear housing chamber intermediate said housing rear wall and said partition,
said partition having a circular opening therethrough;
said housing having a front chamber outlet positioned in communication with said housing front chamber;
said housing having a rear chamber outlet positioned in communication with said rear housing chamber;
said housing having an intake opening in communication with said front chamber;
an impeller,
said impeller having a rear circular plate and a mounting hub, and a plurality of blades,
said mounting hub adapted to be rotatably driven and positioned at a center of said rear circular plate;
each of said blades affixed to said rear circular plate,
each of said blades radiating from said mounting hub,
each of said blades having a blade top edge
each of said blades having a blade height
said blade height of each of said blades sufficient to position said blade top edge adjacent said housing front wall when said impeller is installed in said blower;
each of said blades having a main blade section,
said main blade section having a lower main blade section,
said lower main blade section extending from proximate said center of said rear circular plate to proximate an outer edge of the rear circular plate,
said lower main blade section increasing in height distant said center of said rear circular plate,
said lower main blade section height of each of said lower main blade section sufficient to position said lower main blade section within said rear housing chamber when said impeller is installed in said blower;
said main blade section having an upper main blade section,
said upper main blade section extending upward from said lower main blade section to said top edge of said blade,
said upper main blade section having a centerline perpendicular to said rear circular plate,
said upper main blade section having an upper blade section inner edge and an upper blade section outer edge,
said upper blade section inner edge nearing said centerline proximate said top edge,
said upper blade section outer edge nearing said centerline proximate said top edge
said main blade section having a lower outer edge,
said lower outer edge proximate said outer edge of said rear circular plate
each of said blades having a first blade extension
said first blade extension extending along said upper main blade section to along said lower main blade section,
said first blade extension having a first blade extension first edge
said first blade extension first edge being distant from said rear circular plate and intermediate said main blade upper section and said rear circular plate,
said first blade extension integrally formed of each of said blades by a bend of approximately 90° in each of said blades from said main blade section; and
each of said blades having a second blade extension
said second blade extension in a plane parallel to said main blade section;
said second blade extension extending away from said main blade section;
said second blade extension extending along said first blade extension
said second blade extension having a second blade extension lower edge
said second blade extension lower edge being distant from said first blade extension first edge and intermediate said main blade upper section and said rear circular plate, said second blade extension integrally formed on said first blade extension by a bend of approximately 90° in each of said blades, said second blade extension having an second blade extension outer edge, and said second blade extension outer edge parallel to said housing longitudinal axis.

9. The blower of claim 8, wherein said impeller further comprises said rear circular plate being solid.

10. The blower of claim 9, wherein said impeller further comprises each of said blades being inclined relative to said longitudinal axis.

11. The blower of claim 10, wherein said impeller further comprises a front plurality of struts, each of said front plurality of struts affixed to a plurality of said main blade section of each of said blades at said top edge.

12. The blower of claim 9, wherein said impeller further comprises each of said blades being inclined in a direction of rotation of said impeller.

13. The blower of claim 12, wherein said impeller further comprises each of said blades being inclined about 70 degrees relative to said centerline in said direction of rotation of said impeller.

14. The blower of claim 12, wherein said impeller further comprises a front circular plate, said front circular plate affixed to said blade at said top edge, and said front circular plate having a circular opening therethrough.

* * * * *